US005492449A

United States Patent [19]

Hunklinger et al.

[11] Patent Number: 5,492,449

[45] Date of Patent: Feb. 20, 1996

[54] PISTON DIAPHRAGM PUMP FOR THE DELIVERY OF LIQUIDS IN DOSES

[75] Inventors: Herbert Hunklinger, Siegsdorf; Joachim Klein, Vachendorf, both of Germany

[73] Assignee: Lang Apparatebau Gesellschaft mit beschraenkter Haftung, Siegsdorf, Germany

[21] Appl. No.: 204,379

[22] PCT Filed: Sep. 3, 1992

[86] PCT No.: PCT/EP92/02029

§ 371 Date: May 11, 1994

§ 102(e) Date: May 11, 1994

[87] PCT Pub. No.: WO93/05293

PCT Pub. Date: Mar. 8, 1993

[30] Foreign Application Priority Data

Sep. 11, 1991 [DE] Germany ..... 41 30 166.8

[51] Int. Cl.[6] ..... F04B 17/04

[52] U.S. Cl. ..... 417/259; 417/413.1; 417/417

[58] Field of Search ..... 417/413.1, 412, 417/259, 417, 418

[56] References Cited

U.S. PATENT DOCUMENTS

| | | | |
|---|---|---|---|
| 3,381,616 | 5/1968 | Wertheimer et al. | 417/259 X |
| 3,518,030 | 6/1970 | Klees | 417/259 |
| 4,278,406 | 7/1981 | Cooperrider | 417/413.1 X |
| 4,309,153 | 1/1982 | Panick et al. | 417/418 X |
| 4,383,504 | 5/1983 | Walsworth | 417/418 X |
| 4,643,653 | 2/1987 | Masaka et al. | 417/417 X |

FOREIGN PATENT DOCUMENTS

| | | | |
|---|---|---|---|
| 593400 | 3/1960 | Canada | 417/413.1 |
| 0054797 | 8/1950 | France . | |
| 2831437 | 1/1980 | Germany . | |

*Primary Examiner*—Richard E. Gluck

*Attorney, Agent, or Firm*—Ernest G. Szoke; Wayne C. Jaeschke; Kenneth Watov

[57] ABSTRACT

A piston diaphragm pump operable for delivering doses of liquids such as surfactants, or wetting agents, for example, includes a pump piston that is reciprocally moveable within a pump tube that encloses a pump pressure chamber. The pump piston is electromagnetically driven against the force of a return spring by a magnetic coil that surrounds the pump tube. In addition, a pump diaphragm is rigidly clamped about an inner circumference to a portion of an upper end of the pump piston. The outer circumference of the pump diaphragm is rigidly clamped about its periphery between upper and middle housing sections. One side of the diaphragm faces a suction chamber, and the other side faces a pressure chamber. A longitudinal bore, that encloses a pump piston provided with a piston valve, extends centrally through the pump diaphragm and links the pressure chamber to the suction chamber. In order to obtain the same pump capacity with reduced pump lifts, without requiring a specially sealed guidance of the pump piston in the pump tube, a pressure chamber located on the side of the pump diaphragm opposite to the suction chamber is designed as an additional pump pressure chamber that is constantly connected to the piston longitudinal bore that leads to the pump tube pressure chamber by cross-channels arranged in the pump piston behind the piston valve.

15 Claims, 1 Drawing Sheet

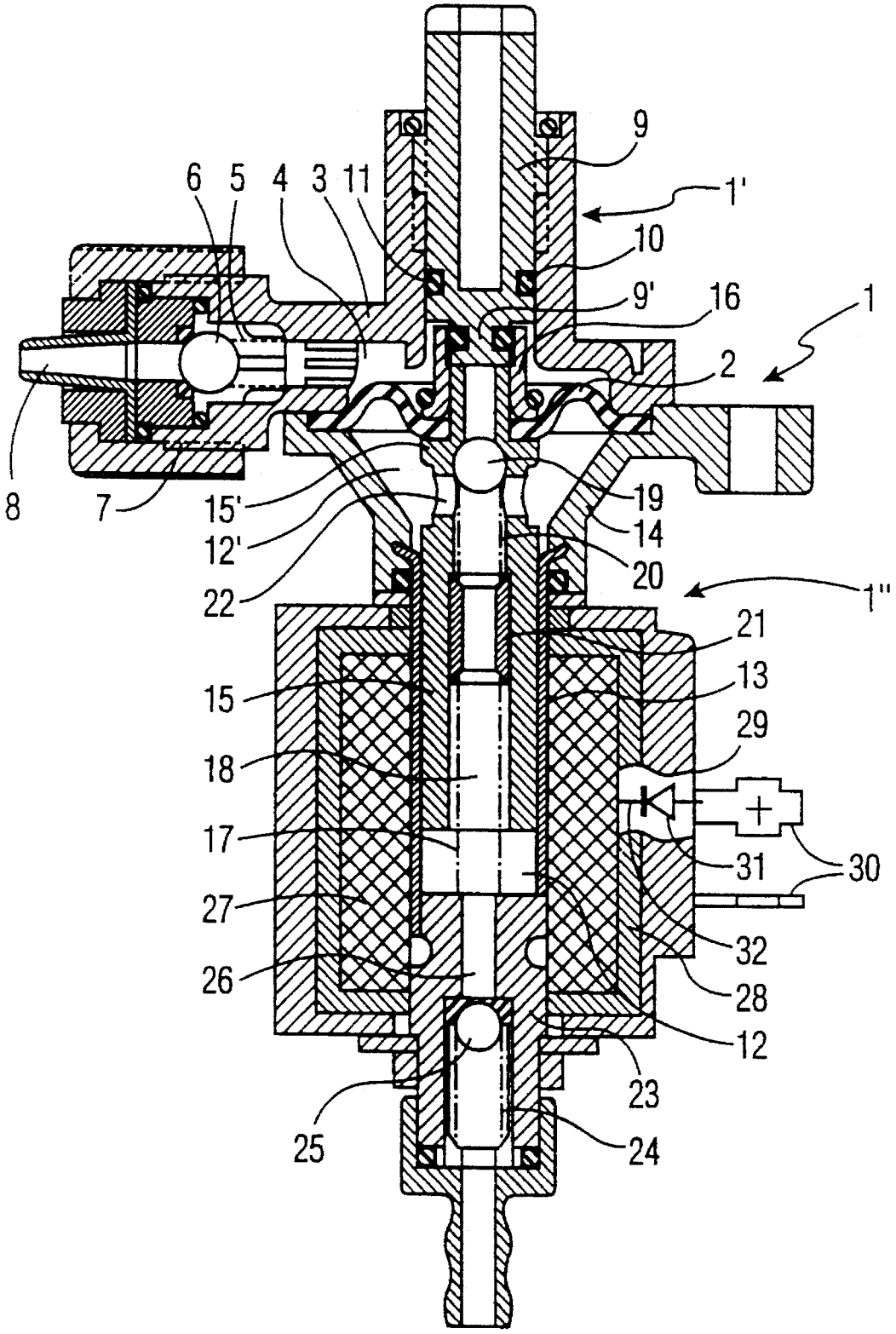
9
6
5
4
3
11
1'
10
9'
16
1
2
8
7
15'
12'
22
19
14
20
1"
21
15
13
29
18
17
31
30
27
32
26
28
12
23
25
24

PISTON DIAPHRAGM PUMP FOR THE DELIVERY OF LIQUIDS IN DOSES

BACKGROUND

1. Field of the Invention

This invention relates generally to a piston diaphragm pump for the delivery of liquids, and more particularly surfactants, wetting agents or the like, in doses.

2. Discussion of Related Art

A piston diaphragm pump of the above type is known from DE-OS 28 31 437. In this known piston diaphragm pump, the particular liquid is drawn into the suction chamber through the flexible diaphragm. The liquid to be dosed is displaced from the pressure chamber solely by the pump piston which is fixedly connected to the diaphragm and which, to this end, is sealingly guided in the pump tube surrounding the pressure chamber. Not only does this require corresponding sealing, it can also lead to seizing of the pump piston after prolonged breaks in operation through drying of the liquid to be dosed. Since, in addition, the pump piston has a much smaller effective cross-section than the pump diaphragm and since both operate with the same lift because they are fixedly connected at both ends, less liquid is always displaced from the pump pressure chamber during the particular delivery stroke of the pump than is taken into the suction chamber through the diaphragm. The result of this is that the suction chamber has to be connected to the liquid reservoir by a special liquid line designed to be shut off by a non-return valve to enable the quantity of liquid delivered in excess into the suction chamber to be returned to the reservoir during the return stroke of the pump membrane. Another disadvantage of the known pump is that, because of its comparatively small delivery cross-section, the pump piston and, hence, the diaphragm have to complete comparatively large strokes to enable a certain volume of liquid to be delivered in dosed form.

3. Summary of the Invention

Accordingly, the problem addressed by the present invention is to improve and complete a piston diaphragm pump of the type mentioned above so that it does not have any of the disadvantages mentioned above and, instead, operates with shorter pump strokes for delivering comparable quantities of liquid, without requiring sealed guiding of the pump piston in the pump tube, thereby preventing seizing of the piston after prolonged breaks in operation. The modified piston diaphragm pump of the invention includes a working chamber lying on the side of the pump diaphragm remote from the suction chamber serving as an additional pump pressure chamber which is permanently connected to a longitudinal bore through a piston leading to the pump tube pressure chamber by transverse channels present in the pump piston behind the piston valve. This ensures that the pumping movements of the diaphragm also become fully effective on the pressure chamber side with the pump piston serving as a drive element for the pump diaphragm designed to be actuated by an electromagnetic coil with a return spring acting thereon. Accordingly, the piston does not have to be specially sealed in the pump tube as in the prior art, but instead may be guided therein with greater tolerances, so that there is virtually no danger of seizing through liquid which has dried out after prolonged breaks in operation. Since, in addition, the liquid to be displaced from the pressure chamber via the pump diaphragm corresponds in volume to the particular quantity of liquid drawn into the suction chamber, there is no need for a special return pipe from the suction chamber to the liquid reservoir, as in the prior art. Comparable delivery volumes of liquid can be obtained with relatively small delivery strokes of the diaphragm and, hence, the pump piston which in turn leads—in the same way as its unsealed guiding in the pump tube—to less heating and to reduced friction losses relative to the prior pump.

The piston valve is preferably provided in the immediate vicinity of that end of the pump piston which passes through the pump diaphragm, while the transverse channels are preferably provided immediately behind that end of the pump piston. This provides for a particularly compact construction of that part of the pump situated on the pressure chamber side, particularly if, in addition, the pump housing is tapered in the manner of a funnel towards the pump tube in its region surrounding the transverse channels and the diaphragm pressure chamber.

In another embodiment of the invention, a pump piston stop provided with a seal is advantageously provided in that part of the housing which surrounds the pump suction chamber, acting as a safety valve separating the pressure chamber from the suction chamber in the stop position of the pump piston brought about by the return spring. In this manner, unwanted flow of the delivery medium from the pressure chamber into the suction chamber and vice versa is effectively prevented, even after prolonged periods of stoppage of the pump when the piston valve may possibly be prevented from closing by dry, crystallized liquid residues.

Finally, in another embodiment of the invention, a rectifier which converts the current supplying the magnetic coil into pulsating direct current is built into the current lead and is preferably integrated into that part of the pump housing which surrounds the electromagnetic coil. This provides for quiet, current-saving driving of the diaphragm pump through the pump piston acting as an armature. The switching on and off of the electromagnetic diaphragm drive is generally controlled by a pulse generator which is installed in the consumer pipe or container to be charged with the liquid to be dosed, and which responds to the particular demand for that liquid.

BRIEF DESCRIPTION OF THE DRAWING

One preferred embodiment of the piston diaphragm pump according to the invention is shown as an axial longitudinal section on a scale of about 2:1 in the accompanying drawing.

The piston diaphragm pump illustrated comprises a multi-compartment pump housing 1 which is divided by the pump diaphragm 2 peripherally clamped in the housing into an upper intake zone 1' and a lower pressure zone 1" which also accommodates the pump drive.

In the suction zone 1', the suction chamber 4 is situated between the upper part 3 of the housing and the diaphragm 2. The suction chamber 4 is designed to be connected to a reservoir (not shown) for the liquid to be dosed via the suction valve—consisting of the spring 5, the valve ball 6 and the associated seal 7—and the connecting socket 8 and a feed line to be mounted thereon. In addition, the upper part 3 of the housing accommodates the stroke adjustment screw 9 mounted for displacement therein. The stroke adjustment screw 9 is sealingly guided with respect to the upper part 3 of the housing by the O-ring 10. In addition, the stroke adjustment screw 9 comprises a front end 9' of stepped diameter which acts both as a pump piston stop in conjunction with the O-ring 11 embedded therein and as a safety valve in conjunction with the facing end of the piston pump, as will be described in more detail hereinafter.

The pump tube 13 surrounding the pump pressure chamber 12 is provided in the lower pump zone 1", being fixedly connected at its upper end to the middle part 14 of the housing. The middle part 14 of the housing is tapered in the manner of a funnel towards the pump tube 13. Together with the pump diaphragm 2, the middle part 14 surrounds an additional pump pressure chamber 12' which is permanently connected to the above-mentioned pressure chamber 12 surrounded by the tube 13.

The pump piston 15 consisting of soft iron is guided for displacement in the pump tube 13 without any sealing. At its upper end 15', the pump piston 15 is fixedly connected to the diaphragm 2 through which it centrally passes. The fixed connection is established by the bushing 16 which is designed to be screwed onto the end 15' of the pump piston 15, projecting beyond it, and which, in the illustrated inoperative position of the pump piston 15, surrounds the front end 9' and the O-ring seal 11 of the stroke adjustment screw 9 present thereon and, thereby acting as a safety valve.

The pump piston 15 is under the effect of the return spring 17 which seeks to keep it in the inoperative position illustrated. The piston 15 is additionally provided with a longitudinal bore 18 which extends over its entire length and at the upper end of which the piston valve consisting of the valve ball 19 and the return spring 20 is installed in the immediate vicinity of the diaphragm 2. The abutment 21 built into the longitudinal bore 18 of the piston 15 acts as a support for the two springs 17 and 20. The transverse channels 22 through which the diaphragm pressure chamber 12' is permanently connected to the longitudinal bore 18, and hence to the pressure chamber 12 are machined into the piston immediately below the piston 15 valve ball 19. Accordingly, the chambers 12 and 12' form a common pump pressure chamber of comparatively large volume.

The pump pressure chamber 12 is closed underneath by the closure element 23 which is fixedly connected to the pump tube 13, and which accommodates the pump pressure valve consisting of the spring 24 and the pressure valve ball 25, the pump pressure valve enabling the pressure line 26 leading to the consumer in the closure element 23 to be shut off and opened.

Arranged directly around the pump tube 13 is the magnetic coil 27 which, after corresponding excitation with current, enables the pump piston 15 to be driven against the force of the return spring 17 acting thereon for delivery of the particular medium. The magnetic coil 27 is surrounded by the plastic jacket 28 which in turn is surrounded by the part 29 of the housing on the outside of which the two current or voltage terminals 30 are provided. A rectifier 31 as schematically shown, is accommodated in the housing 29 and electrically connected between a current terminal 30 and a current lead 32 to the magnetic coil 27, for converting the current supplied to the magnetic coil 27 into pulsating direct current.

If the magnetic coil 27 is excited with current by a pulse generator (not shown) which is present in the vicinity of the consumer and which monitors the demand for the liquid to be dosed, the pump piston 15 and the diaphragm 2 fixedly connected thereto are moved downwards in the drawing so that, on the one hand, liquid is delivered from the common pressure chamber 12,12' into the consumer line through the pressure valve ball 25, while the suction chamber 4 is refilled with the corresponding quantity of liquid to be dosed through the diaphragm 2 via the suction valve 6 which then opens. The piston valve ball 19 is in the closed position during the above-described movement of the diaphragm 2 and piston 15. When the electromagnetic drive is switched off after sufficient liquid has been dosed, the pump piston 15 and the diaphragm 2 fixedly connected thereto return to their inoperative positions shown in the drawing. During this return movement, the suction valve ball 6 and the pressure valve ball 25 are in closed positions, whereas the piston valve ball 19 is moved to an opened position so that liquid is able to pass from the suction chamber 4 into the common pressure chamber 12,12'. Towards the end of this return movement under the effect of the spring 17, the fixing bushing 16 screwed onto the end 15' of the piston pump 15 travels beyond the O-ring 11 of the stop end 9' present on the stroke adjustment screw 9. This establishes an additional, effective seal between the suction chamber 4 and the pressure chambers 12 and 12', which is particularly important should the piston valve balls 19 and also the other two valve balls 6 and 25 no longer effectively more to closed positions, for example through the presence of crystallized liquid residues.

We claim:

1. A piston diaphragm pump for the delivery of liquids such as surfactants or wetting agents, in doses, said pump comprising:

a pump housing including a piston chamber;

a pump piston including a full-length longitudinal bore;

a pump tube in which said pump piston is contained and displaceably guided for reciprocal movement, said pump tube forming a portion of said piston chamber;

a return spring located in said pump tube for spring biasing said pump piston to an inoperative position;

a magnetic coil surrounding said pump tube, said magnetic coil being energizable for electromagnetically driving said pump piston against the spring biasing force of said return spring;

a pump diaphragm;

said pump housing further including a pump suction chamber, said pump diaphragm being peripherally clamped in said pump housing at a position facing one end of said piston chamber;

said pump diaphragm being centrally traversed by said pump piston, said longitudinal bore of said pump piston both connecting and providing a liquid passageway between a first pressure chamber and said suction chamber;

a piston valve installed in the longitudinal bore of said pump piston;

a second pressure chamber located on a side of said pump diaphragm remote from said suction chamber, said second pressure chamber being permanently connected to the longitudinal bore of said pump piston, said longitudinal bore of said pump piston serving to provide a fluid pathway between said first pressure chamber and said second pressure chamber;

transverse channels cut through side walls of said pump piston behind said piston valve, provide a fluid pathway from said second pressure chamber into said longitudinal bore of said piston pump, and therethrough to said first pressure chamber;

an inlet port including a first one-way valve assembly installed on said pump housing for passing liquid into said pump suction chamber, whenever said pump piston and diaphragm move in a suction stroke away from said pump suction chamber; and an outlet port including a second one-way valve assembly installed in an end of said pump tube proximate said second pressure chamber.

2. A pump as claimed in claim 1, further including the piston valve being provided in the immediate vicinity of that end of the pump piston which passes through the pump diaphragm while the transverse channels are located immediately behind that end of the pump piston.

3. A pump as claimed in claim 2, further including the pump housing being tapered/narrowed towards the pump piston in its region surrounding the transverse channels and the diaphragm pressure chamber.

4. A pump as claimed in claim 1, further including a pump piston stop provided with a seal in that part of the housing which surrounds the pump suction chamber, acting as a safety valve separating the pressure chamber from the suction chamber in a stop position of the pump piston brought about by the return spring.

5. A pump as claimed in claim 4, further including the pump piston stop being formed by a front end—facing the pump piston— of a stroke adjustment screw mounted for adjustment in the housing, the front end being stepped in diameter, being provided with an O-ring as a seal and being designed for sealing displacement from the facing of the pump piston into its stop position.

6. A pump as claimed in claim 5, further including a screwthreaded bushing being provided on that end of the pump piston which passes through the pump diaphragm and secures the diaphragm on the pump piston, the pump piston in its rest or stop position projecting beyond the front end of the stoke adjustment screw by way of said bushing.

7. A pump as claimed in claim 1, further including a rectifier which converts the current supplying the magnetic coil into pulsating direct current, said rectifier being built into a current lead to the magnetic coil.

8. A pump as claimed in claim 7, further including the rectifier being integrated into that part of the pump housing which surrounds the electromagnetic coil.

9. A pump as claimed in claim 6, further including a rectifier which converts the current supplying the magnetic coil into pulsating direct current, said rectifier being built into a current lead to the magnetic coil.

10. A pump as claimed in claim 2, further including a pump piston stop provided with a seal in that part of the housing which surrounds the pump suction chamber, acting as a safety valve separating the pressure chamber from the suction chamber in a stop position of the pump piston brought about by the return spring.

11. A pump as claimed in claim 3, further including a pump piston stop provided with a seal in that part of the housing which surrounds the pump suction chamber, acting as a safety valve separating the pressure chamber from the suction chamber in a stop position of the pump piston brought about by the return spring.

12. A pump as claimed in claim 2, further including a rectifier which converts the current supplying the magnetic coil into pulsating direct current, said rectifier being built into a current lead to the magnetic coil.

13. A pump as claimed in claim 3, further including a rectifier which converts the current supplying the magnetic coil into pulsating direct current, said rectifier being built into a current lead to the magnetic coil.

14. A pump as claimed in claim 4, further including a rectifier which converts the current supplying the magnetic coil into pulsating direct current, said rectifier being built into a current lead to the magnetic coil.

15. A pump as claimed in claim 5, further including a rectifier which converts the current supplying the magnetic coil into pulsating direct current, said rectifier being built into a current lead to the magnetic coil.

* * * * *